US008585199B2

(12) United States Patent
Takemoto

(10) Patent No.: US 8,585,199 B2
(45) Date of Patent: Nov. 19, 2013

(54) INK JET RECORDING SYSTEM AND RECORDING METHOD

(75) Inventor: Kiyohiko Takemoto, Matsumoto (JP)

(73) Assignee: Seiko Epson Corporation (JP)

( * ) Notice: Subject to any disclaimer, the term of this patent is extended or adjusted under 35 U.S.C. 154(b) by 354 days.

(21) Appl. No.: 13/013,074

(22) Filed: Jan. 25, 2011

(65) Prior Publication Data

US 2011/0181675 A1 Jul. 28, 2011

(30) Foreign Application Priority Data

Jan. 27, 2010 (JP) ..... 2010-015130
Aug. 2, 2010 (JP) ..... 2010-173379

(51) Int. Cl.
*B41J 2/01* (2006.01)

(52) U.S. Cl.
USPC ..... 347/102; 347/100; 347/101

(58) Field of Classification Search
USPC ..... 347/100, 95, 96, 102, 101, 103, 105, 347/88, 99; 106/31.13, 31.6, 31.27; 523/160, 161
See application file for complete search history.

(56) References Cited

U.S. PATENT DOCUMENTS

| | | | | |
|---|---|---|---|---|
| 5,479,199 | A | 12/1995 | Moore et al. | |
| 5,764,263 | A * | 6/1998 | Lin | 347/102 |
| 5,952,401 | A * | 9/1999 | Kimura et al. | 523/161 |
| 6,561,640 | B1 * | 5/2003 | Young | 347/102 |
| 2004/0196330 | A1 * | 10/2004 | Sekiya | 347/42 |
| 2005/0104946 | A1 * | 5/2005 | Siegel | 347/102 |
| 2006/0238592 | A1 * | 10/2006 | Kadomatsu et al. | 347/102 |
| 2007/0058019 | A1 * | 3/2007 | Saitoh et al. | 347/101 |
| 2007/0165088 | A1 * | 7/2007 | Maeno et al. | 347/100 |
| 2007/0200888 | A1 * | 8/2007 | Inoue et al. | 347/102 |
| 2008/0174648 | A1 | 7/2008 | Nakano et al. | |
| 2010/0080913 | A1 * | 4/2010 | Irita | 427/258 |

FOREIGN PATENT DOCUMENTS

| | | | |
|---|---|---|---|
| JP | 6-126952 | A | 5/1994 |
| JP | 2008-188983 | A | 8/2008 |

OTHER PUBLICATIONS

The translation of pp. 3 to 6 from p. 9 to 11 from Non-Patent Document, p. 20-21 Dendritic Kobunshi-Tabunki Kozo ga Hirogeru Koukinouka no Sekai-(Dendritic Polymers—World of High Functionalization Diversified by Multibranched Structures-), Keigo AOI and Masaaki Kakimoto (supervisors), NTS Inc), published Oct. 31, 2005.

* cited by examiner

*Primary Examiner* — Manish S Shah
(74) *Attorney, Agent, or Firm* — Harness, Dickey & Pierce, P.L.C.

(57) ABSTRACT

An ink jet recording system, contains a recording head that ejects ink to the surface of a target non-ink-absorbing or low ink-absorbing recording medium; a medium support portion that faces the recording head and supports the target recording medium from the back surface; a drying portion as a first fixing portion that evaporates a liquid ingredient of the ink that is ejected to the target recording medium from the recording head and adheres thereto; and a second fixing portion at the downstream side with respect to the drying portion of a feeding direction of the target recording medium, the second fixing portion is an irradiation device that irradiates the target recording medium with ultraviolet ray or electron beam, and the evaporation amount of the liquid ingredient in the drying portion is 40 to 70% by weight of the ink adhering to the target recording medium.

8 Claims, 5 Drawing Sheets

FIG. 4

| | | TEST 1 | | | TEST 2 | | | TEST 3 | | | TEST 4 | | | TEST 5 | | | TEST 6 | | |
|---|---|---|---|---|---|---|---|---|---|---|---|---|---|---|---|---|---|---|---|
| INK EVAPORATION AMOUNT IN FIRST FIXING PORTION | | 30% | | | 40% | | | 50% | | | 60% | | | 70% | | | 80% | | |
| ULTRAVIOLET RAY IRRADIATION TIME IN SECOND FIXING PORTION | | 10 SECONDS | | | 10 SECONDS | | | 5 SECONDS | | | 5 SECONDS | | | 5 SECONDS | | | 5 SECONDS | | |
| TARGET RECORDING MEDIUM | | PVC | PET | PP | PVC | PET | PP | PVC | PET | PP | PVC | PET | PP | PVC | PET | PP | PVC | PET | PP |
| PRINTING EVALUATION | I. BEADING | A | B | B | A | A | A | A | A | A | A | A | A | A | A | A | A | A | A |
| | II. SOLID UNEVENNESS | A | A | B | A | A | A | A | A | A | A | A | A | A | A | A | B | B | B |
| | III. COLOR BLEED | A | B | B | A | A | A | A | A | A | A | A | A | A | A | A | A | A | A |
| DIRT OF PRINTED MATTER IN PORTIONS OF FORTH FEEDING ROLLER 71 TO SEVENTH FEEDING ROLLER 74 | | NONE | NONE | NONE | NONE | NONE | NONE | NONE | NONE | NONE | NONE | NONE | NONE | NONE | NONE | NONE | NONE | NONE | NONE |

FIG. 5

| | | TEST 7 | | |
|---|---|---|---|---|
| INK EVAPORATION AMOUNT IN FIRST FIXING PORTION | | 50% | | |
| ULTRAVIOLET RAY IRRADIATION TIME IN SECOND FIXING PORTION | | 20 SECONDS | | |
| TARGET RECORDING MEDIUM | | PVC | PET | PP |
| PRINTING EVALUATION | I. BEADING | A | B | B |
| | II. SOLID UNEVENNESS | A | B | B |
| | III. COLOR BLEED | A | B | B |
| DIRT OF PRINTED MATTER IN PORTIONS OF FORTH FEEDING ROLLER 71 TO SEVENTH FEEDING ROLLER 74 | | PRESENCE | PRESENCE | PRESENCE |

INK JET RECORDING SYSTEM AND RECORDING METHOD

BACKGROUND

1. Technical Field

The present invention relates to an ink jet recording system and a recording method that perform high-quality image recording at high speed on a target non-ink-absorbing or low ink-absorbing recording medium.

2. Related Art

Heretofore, as described in Japanese Unexamined Patent Application Publication No. 6-126952, an ink jet recording device has been proposed to have a preheating lamp as an ink drying measure and an air blowing measure thereon. Among the above, the preheating lamp is provided in such a manner as to heat a driving roller and the driving roller is constituted so that the target recording medium is heated before passing a printing zone. In contrast, the air blowing measure is constituted in such a manner as to supply a strong wind to the target recording medium immediately after printing in a printing zone and heat the same.

However, when ink jet recording is performed at high speed on a target recording medium having remarkably low ink absorbability, such as cast paper or a plastic film for offset printing, high-quality image printing at high speed cannot be performed by a device using a former drying measure. This is because there has been problems, for example, in that line width unevenness (beading) in printing of ruled lines, color unevenness or mixture of different colors (color bleed) in solid printing, or the like occurs.

SUMMARY

The invention has been made in order to at least partially solve the above-described problems and can realize an ink jet recording system and a recording method that perform ink jet recording at high speed on a target recording medium having remarkably low ink absorbability in the following aspects or embodiments.

In order to solve the above-described problems, a first aspect of the invention is an ink jet recording system having a recording head that ejects ink to the surface of a target non-ink-absorbing or low ink-absorbing recording medium, a medium support portion that faces the recording head and supports the target recording medium from the back surface, a drying portion as a first fixing portion. that evaporates a liquid ingredient of the ink that is ejected to the target recording medium from the recording head and adheres thereto, and a second fixing portion at the downstream side with respect to the drying portion of a feeding direction of the target recording medium, in which the ink at least contains (1) a coloring agent, (2) a monomer which is an organic solvent having a boiling point of 100° C. or more and 250° C. or lower, (3) a polymerizable oligomer and/or polymer, and (4) a photopolymerization initiator, the second fixing portion is an irradiation device that irradiates the target recording medium with ultraviolet ray or electron beam, and the evaporation amount of the liquid ingredient in the drying portion is 40 to 70% by weight of the ink adhering to the target recording medium.

According to the first aspect, the ink jet recording system has the drying portion as the first fixing portion that evaporates 40 to 70% by weight of the ink adhering to the target recording medium and the irradiation device that irradiates the target recording medium with ultraviolet ray or electron beam as the second fixing portion provided at the downstream side with respect to the drying portion of the feeding direction of the target recording medium. Therefore, by evaporating 40% by weight or more of the ink adhering to the target recording medium In the drying portion also in the case of printing at high speed, the occurrence of line width unevenness (beading) in printing of ruled lines to the target recording medium, color unevenness or mixture of different colors (color bleed) in solid printing, or the like can be prevented. In addition, by not evaporating more than 70% by weight of the ink adhering to the target recording medium in the drying portion, the adhesion dot diameter of ink droplets can be secured on the target recording medium and the occurrence of discontinuous lines in the case of printing of ruled lines or unevenness in the case of solid printing can be prevented. Moreover, a reduction in the scratch resistance due to an increase in the thickness of the adhesion dot of ink droplets can also be prevented.

According to a second aspect, in the ink jet recording system above, (1) the coloring agent, (2) the monomer which is an organic solvent having a boiling point of 100° C. or more and 250° C. or lower, (3) the polymerizable oligomer and/or polymer, and (4) the photopolymerization initiator contained in the ink contain (1) 0.2 to 10% by weight of a pigment as the coloring agent, (2) 30 to 70% by weight of one or two or more kinds of organic solvents selected from the group consisting of allyl glycol, N-vinyl formamide, (2-methyl-2-ethyl-1,3-dioxolane-4-yl-)methylacrylate, phenoxy ethyl acrylate, isobonyl acrylate, methoxy diethylene glycol monoacrylate, acryloyl morpholine, ethylene glycol dimethacrylate, diethylene glycol dimethacrylate, tripropylene glycol diacrylate, 1,9-nonanediol diacrylate, polyethylene-glycol #400 diacrylate, tetraethylene glycol dimethacrylate, 1,6-hexanediol dimethacrylate, neopentylglycol dimethacrylate, 2-hydroxy-1,3-dimethacryloxy propane, trimethylol propane trimethacrylate, trimethylolpropane modified triacrylate, trimethylolpropane PO modified triacrylate, and glycerin PO modified triacrylate as the monomer, (3) 10 to 50% by weight of the polymerizable oligomer and/or polymer, and (4) 3 to 10% by weight of the photopolymerization initiator.

The second aspect can be preferably adopted as the ink of the first aspect of the invention and can further increase the effects of the ink jet recording system according to the first aspect of the invention.

According to a third aspect, in the ink jet recording system above, the ink contains (5) a mildly volatile organic solvent having a boiling point of 100° C. or more and 250° C. or lower and/or water.

The third aspect can be preferably adopted as the ink of the first or second aspect of the invention and can further increase the effects of the ink jet recording system according to the first aspect of the invention.

According to a fourth aspect, in the ink jet recording system above, (5) the mildly volatile organic solvent having a boiling point of 100° C. or more and 250° C. or lower contained in the ink contains one or two or more organic solvents selected from the group consisting of N-methyl pyrrolidone, N-ethyl pyrrolidone, N-vinyl pyrrolidone 2-pyrrolidone, dimethylsulfoxide, ε-caprolactam, methyl lactate, ethyl lactate, isopropyl lactate, butyl lactate, ethylene glycol monomethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, propylene glycol monomethyl ether, dipropylene glycol monomethyl ether, dipropyrene glycol dimethyl ether, 1,4-dioxane, ethylene glycol, diethylene glycol, propylene glycol, dipropyrene glycol, 1,3-propanediol, 1,4-butanediol, hexylene glycol, n-butanol, 1,2-hexanediol, 1,3-hexanediol, 1,2-heptanediol, 1,3-heptanediol, 1,2-octanediol, 1,3-octanediol, 1,2-pentanediol, triethylene glycol monobutyl ether, diethylene glycol monobutyl ether, diethylene glycol monopropyl ether, diethylene glycol monopentyl ether, and propylene glycol monobutyl ether.

The fourth aspect can be preferably adopted as the ink of the third aspect of the invention and can further increase the effects of the ink jet recording system according to the first aspect of the invention.

A fifth aspect is an ink jet recording method by the ink jet recording system above and the ink jet recording method includes: ejecting ink to the surface of the target non ink-absorbing or low ink-absorbing recording medium by the recording head; evaporating a liquid ingredient of the ink adhering to the target recording medium in an amount of 40 to 70% by weight by the drying portion; and irradiating the target recording medium, in which the liquid ingredient is evaporated in the drying portion, with ultraviolet ray or electron beam by the irradiation device as the second fixing portion, and polymerizing and curing remaining ingredients after evaporating the liquid ingredient of the ink.

The fifth aspect can provide a method for performing ink jet recording at high speed on a target recording medium having remarkably low ink absorbability by the ink jet recording system according to any one of the first to fourth aspects.

BRIEF DESCRIPTION OF THE DRAWINGS

The invention will he described with reference to the accompanying drawings, wherein like numbers reference like elements.

FIG. 4 illustrates printing evaluation results of Tests 1 to 6.

FIG. 5 illustrates printing evaluation results of Test 7.

DESCRIPTION OF EXEMPLARY EMBODIMENTS

Hereinafter, the embodiments of the invention will be described with reference to the drawings.

Figure 1:
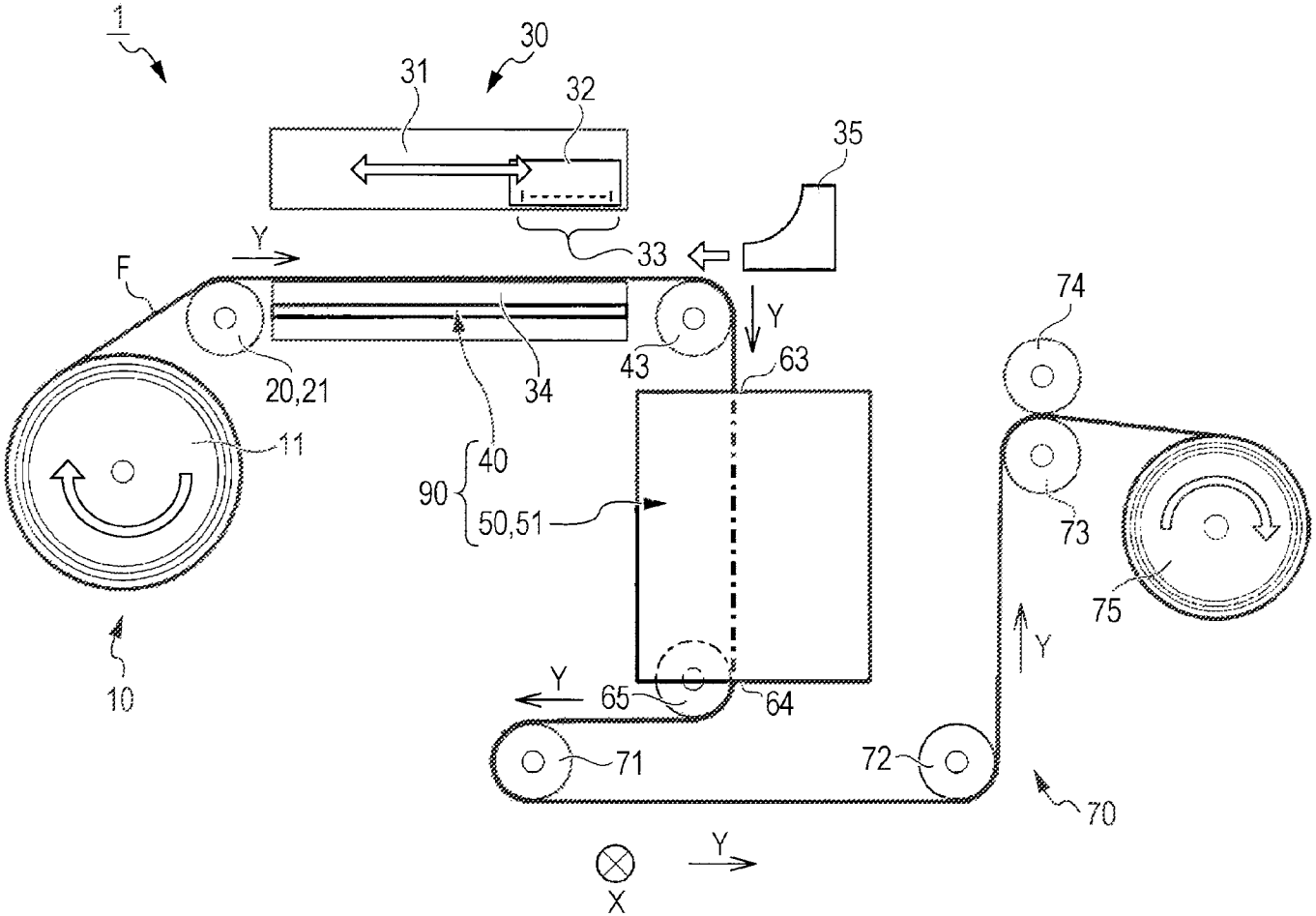
FIG. 1 is a side view illustrating the outline of an entire printer according to this embodiment.

FIG. 1 illustrates a side view illustrating the outline of an entire ink jet recording device 1 according to this embodiment.

As illustrated in FIG. 1, the ink jet recording device 1 has a feeding portion 10 of a target recording medium, a transporting portion 20, a recording portion 30, a fixing portion 90, and an ejecting portion 70.

Among the above, the fixing portion 90 has a drying portion 40 as a first fixing portion and a second fixing portion 50 described later.

The feeding portion 10 is provided in such a manner as to feed a target roll-shaped recording medium F as an example of the target recording medium to the transporting portion 20.

Specifically, the feeding portion 10 has a roll medium holder 11 and the roll medium holder 11 holds a target roll-shaped recording medium F. It is structured that, by rotating the target roll-shaped recording medium F, the target recording medium F can be fed to the transporting portion 20 at the downstream side of the feed direction.

In this embodiment, the target recording medium F will be described but it is a matter of course that paper or a plastic film may be acceptable.

The transporting portion 20 is provided in such a manner as to transport the target recording medium F fed from the feeding portion 10 to the recording portion 30. Specifically, the transporting portion 20 has a first feeding roller 21 and is structured so that the fed target recording medium F can be further transported to the recording portion 30 at the downstream side of the feed direction.

Furthermore, the recording portion 30 is provided in such a manner as to eject an ink L as an example of a liquid to the target recording medium F fed from the transporting portion 20 and perform recording.

Specifically, the recording portion 30 has a platen 34 as a medium supporting portion, a carriage 31, and a recording head 32. Among the above, the platen 34 is provided in such a manner as to support the target recording medium F from the back surface. The carriage 31 faces the platen 34 and is provided in such a manner as to move in the width direction X to the feed direction Y of the target recording medium F due to the power of a carriage motor which is not illustrated while being guided by a first guide axis which is not illustrated.

The recording head 32 is provided in the carriage 31 and is provided in such a manner as to move in an integral manner with the carriage 31 in the width direction X. In addition, the recording head 32 is structured in such a manner as to relatively move to the carriage 31 in the feed direction Y. Specifically, the recording head 32 is provided in such a manner as to move in the feed direction Y due to the power of the recording head motor which is not illustrated while being guided by a second guide axis which is not illustrated. More specifically, the recording head 32 is structured in such a manner as to move in the feed direction Y and the width direction X in the range where the recording head 32 faces the platen 34. By ejecting the ink L from a line of nozzles 33 provided on the surface facing the platen 34 in the recording head 32, recording can be performed to the target recording medium F.

The platen 34 is further provided with a drying portion 40 that evaporates 40 to 70% by weight of ink ingredients in the ink L adhering to the target recording medium F as described in detail later.

At the downstream side with respect to the platen 34 of the feed direction, a second feeding roller 43 is provided. The second feeding roller 43 is structured so that the recorded target recording medium F can be fed to the second fixing portion 50 at the downstream side of the feed direction.

As described in detail later, the second fixing portion 50 is structured in such a manner as to emit ultraviolet rays or electron beams so that the remaining ingredients in the ink in the ink L adhering to the target recording medium F can be polymerized and cured.

In the vicinity of an outlet 64 of the second fixing portion 50, a third feeding roller 65 is provided. The third feeding roller 65 is provided in such a manner as to contact the back surface of the target recording medium F and is structured in such a manner as to feed the target recording medium F to the ejecting portion 70 at the downstream side of the feed direction.

Furthermore, the ejecting portion 70 is provided in such a manner as to further feed the target recording medium F fed from the second fixing portion 50 to the downstream side of the feed direction, so that the target recording medium F can he ejected to the outside of the ink jet recording device 1. Specifically, the ejecting portion 70 has a fourth feeding roller 71, a fifth feeding roller 72, a sixth feeding roller 73, a seventh feeding roller 74, and a winding roller 75. Among the above, the fourth feeding roller 71 and the fifth feeding roller 72 are provided in such a manner as to contact the surface of the target recording medium F. The sixth feeding roller 73 and the seventh feeding roller 74 are provided in such a manner as to form a roller pair. The target recording medium F ejected by the sixth feeding roller 73 and the seventh feeding roller 74 is wound by the winding roller 75.

Figure 2:
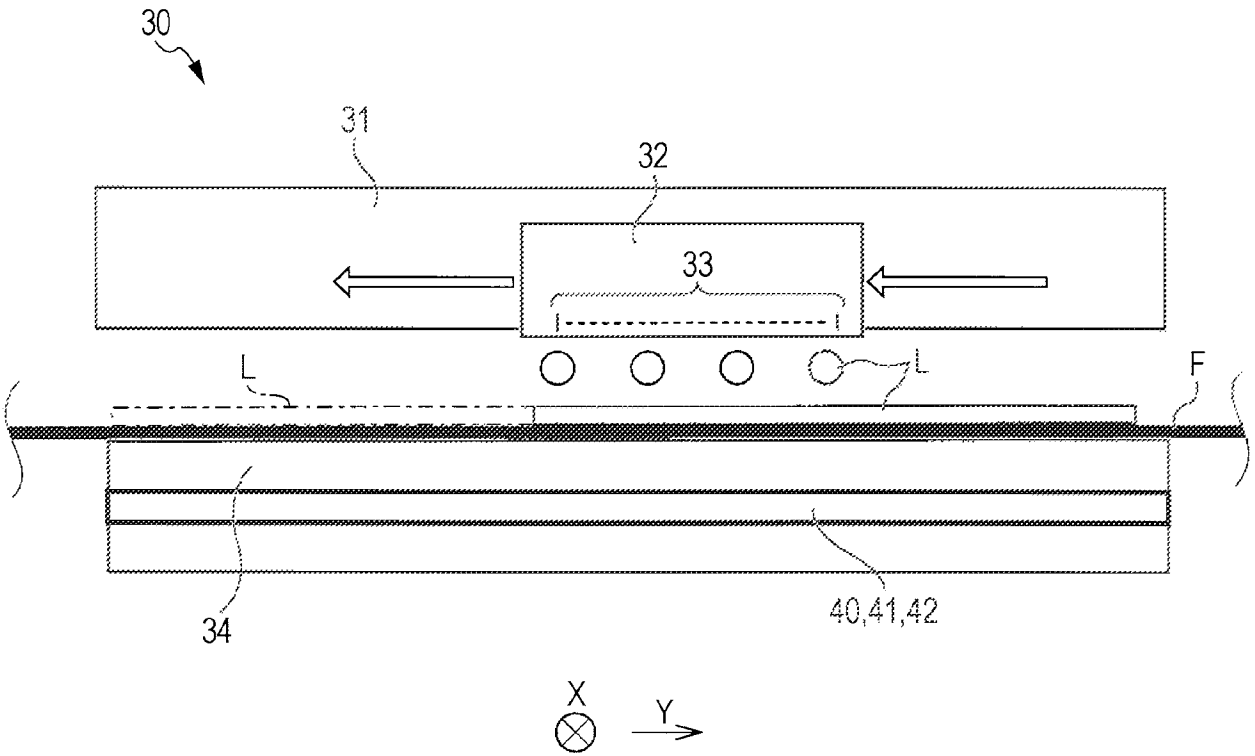
FIG. 2 is a side view illustrating the outline of a recording portion of the printer according to this embodiment.

FIG. 2 illustrates a side view illustrating the outline of a recording portion of the printer according to this embodiment.

As illustrated in FIG. 2, the platen 34 is provided with the drying portion 40. Specifically, the drying portion 40 has a first nichrome wire 42 as an example of a heat conduction type heating measure (heater) 41.

Here, the "heat conduction type" refers to a system in which heat is transmitted from a high temperature portion to a low temperature portion through the inside of an object. More specifically, a system is mentioned in which a high-temperature object contacts the target recording medium, so that heat is transmitted to the target recording medium side. A "convection type" refers to a system in which heat is transmitted by fluid, such as gas or liquid.

The first nichrome wire 42 is provided inside the entire region of the platen 34 in such a manner as to he spaced at a given distance from the upper surface of the platen 34. By energizing, the first nichrome wire 42 itself generates heat so that heat can be transmitted to the back surface of the target recording medium F on the platen 34 contacting the same through the platen 34.

Here, since the first nichrome wire 42 is formed in the entire region of the platen 34, heat can be generated in the entire region of the platen 34. Since the top of the platen 34 is a smooth surface having no irregularities, the upper surface of the platen 34 can uniformly contact the target recording medium F. The distance from the first nichrome wire 42 to the upper surface of the platen 34 is fixed. Therefore, heat can be uniformly transmitted to the target recording medium F on the platen 34. More specifically, the target recording medium F can be uniformly warmed.

The drying portion 40 may be further provided with a hot air fan 35 as a convection type heating measure. By applying hot air onto the surface of the recording-medium F on the platen 34, the liquid ingredients in the ink L adhering to the target recording medium F can be efficiently evaporated. The hot air fan can be replaced by an infrared lamp or both of them can also be provided as required.

As the target recording medium F in this embodiment, a target non-ink-absorbing or low ink-absorbing recording medium is preferably used. Examples of such a target non-ink-absorbing recording medium include one in which a base material, such as a plastic film, paper, or the like, which is not surface treated for ink jet printing (i.e., an ink absorption layer is not formed), is coated with plastic or one in which a plastic film is adhered to such a base material. Examples of the plastic here include polyvinyl chloride, polyethylene terephthalate, polycarbonate, polystyrene, polyurethane, polyethylene, and polypropylene. Examples of the target low ink-absorbing recording medium include printing paper, such as art paper, coated paper, and mat paper.

Here, the target non-ink-absorbing or low ink-absorbing recording medium refers to a target recording medium in which the water absorption amount of the printing surface is 10 mL/m$^2$ or lower from the initiation of contact to 30 msec in the Bristow method. The Bristow method is the most prevailing method as a method for measuring the liquid absorption amount in a short time and is also employed by JAPAN TAPPI, The details of the test method are described in Standard No, 51 "Paper and Paperboard—Liquid Absorbency Test Method—Bristow Method" in "JAPAN TAPPI Paper and Pulp Test Methods 2000 Edition".

The target recording medium F fed to the platen 34 of the recording portion 30 temporarily stops. Then, the carriage 31 moves in the width direction X and the ink L is ejected in a state where the recording head 32 is located at the position facing the downstream side of the feeding direction Y on the platen 34, so that recording is carried out. Next, the recording head 32 moves to the upstream side with respect to the carriage 31 of the feeding direction Y corresponding to the length of the line of nozzles 33. Then, the carriage 31 moves in the width direction X, and the ink L is ejected, so that recording is carried out.

Furthermore, the recording head 32 moves to the upstream side with respect to the carriage 31 of the feeding direction Y corresponding to the length of the line of nozzles 33. Then, the carriage 31 moves in the width direction X, and the ink L is ejected, so that recording is carried out. The above-described operation is repeated two or more times until the recording head 32 moves to the position facing the upstream side of the feeding direction Y of the platen 34, the carriage 31 moves in the width direction X in the state, and then the ink L is ejected, so that recording is carried out. More specifically, scanning is performed two or more times.

Thereafter, the target recording medium F is fed to the downstream side of the feeding direction Y corresponding to the length of the feeding direction Y of the platen 34, i.e., the length of the feeding direction Y of a region recorded by the two or more times of scanning, and temporarily stops again. Then, recording is carried out to the target recording medium F on the platen 34 by two or more times of scanning. The recording is performed by a so-called intermittent feeding.

As the ink L of this embodiment, an ink at least containing (1) a coloring agent, (2) a monomer which is an organic solvent having a boiling point of 100° C. or more and 250° C. or lower, (3) a polymerizable oligomer and/or polymer, and (4) a photopolymerization initiator is preferably used.

Specifically, an ink is mentioned that at least contains:

(1) 0.2 to 10% by weight of a pigment as the coloring agent;

(2) 30 to 70% by weight of one or two or more kinds of organic solvents selected from the group consisting of allyl glycol, N-vinyl formamide, (2-methyl-2-ethyl-1,3-dioxolane-4-yl-)methylacrylate, phenoxy ethyl acrylate, isobonyl acrylate, methoxy diethylene glycol monoacrylate, acryloyl morpholine, ethylene glycol dimethacrylate, diethylene glycol dimethacrylate, tripropylene glycol diacrylate, 1,9-nonanediol diacrylate, polyethylene-glycol #400 diacrylate, tetraethylene glycol dimethacrylate, 1,6-hexanediol dimethacrylate, neopentylglycol dimethacrylate, 2-hydroxy-1,3-dimethacryloxy propane, trimethylol propane trimethacrylate, trimethylolpropane modified triacrylate, trimethylolpropane PO modified triacrylate, and glycerin PO modified triacrylate as the monomer;

(3) 10 to 50% by weight of a polymerizable oligomer and/or polymer, and (4) 3 to 10% by weight of a photopolymerization initiator.

An ink may be acceptable that further contains:

(5) one or two or more organic solvents, as the mildly volatile organic solvent having a boiling point of 100° C. or more and 250° C. or lower, selected from the group consisting of N-methyl pyrrolidone, N-ethyl pyrrolidone, N-vinyl pyrrolidone, 2-pyrrolidone, dimethylsulfoxide, ε-caprolactam, methyl lactate, ethyl lactate, isopropyl lactate, butyl lactate, ethylene glycol monomethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, propylene glycol monomethyl ether, dipropylene glycol monomethyl ether, dipropyrene glycol dimethyl ether, 1,4-dioxane, ethylene glycol, diethylene glycol, propylene glycol, dipropyrene glycol, 1,3-propanediol, 1,4-butanediol, hexylene glycol, n-butanol, 1,2-hexanediol, 1,3-hexanediol, 1,2-heptanediol, 1,3-heptanediol, 1,2-octanediol, 1,3-octanediol, 1,2-pentanediol, triethylene glycol monobutyl ether, diethylene glycol monobutyl ether, diethylene glycol monopropyl ether, diethylene glycol monopentyl ether, and propylene glycol monobutyl ether As the coloring agent for use in chromatic or achromatic color ink, a water-insoluble coloring agent is a so-called pigment. As a preferable coloring agent for an achromatic color black ink, carbon black is mentioned.

Specific examples include No. 2300, 900, MCF88, No. 20B, No. 33, No. 40, No. 45, No. 52, MA7, MA8, MA100, and No. 2200B, (all trade names, manufactured by Mitsubishi Chemical, Inc.), color black FW1, FW2, FW2V, FW18, FW200, S150, S160, S170, Pritex 35, U, V, 140U, Special Black 6, 5, 4A, 4, and 250 (all trade names, manufactured by Degussa), Conductex SC, Raven 1255, 5750, 5250, 5000, 3500, 1255, and 700 (all trade names, manufactured by Colombia Carbon), Regal 400R, 330R, and 660R, Mogul L, Monarch 700, 800, 880, 900, 1000, 1100, 1300, and 1400, and Elftex 12 (all trade names, manufactured by Cabot Corp.). The carbon blacks above are mentioned as one example of carbon blacks suitable for the invention, and the invention is not limited by the description. These carbon blacks may be used alone or as a mixture of two or more kinds thereof.

Examples of preferable organic pigments for a chromatic color ink include quinacridone pigments, quinacridone-quinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perynone pigments, quinophthalone pigments, anthraquinone pigments, thioindigo pigments, benzimidazolone pigments, isoindolinone pigments, azomethine pigments, and azo pigments.

Examples of cyan pigments include C.I. Pigment blue 1, 2, 3, 15:3, 15:4, 15:34, 16, 22, and 60; and C.I. Vat blue 4 and 60, and preferable examples include a single pigment or a mixture of two or more pigments selected from the group consisting of C.I. Pigment blue 15:3, 15:4, and 60.

Examples of magenta pigments include C.I. Pigment red 5, 7, 12, 48 (Ca), 48 (Mn), 57 (Ca), 57:1, 112, 122, 123, 168, 184, and 202 and C.I. Pigment violet 19 and preferable examples include a single pigment or a mixture of two or more pigments selected from the group consisting of C.I. Pigment red 122, 202, and 209 and C.I. Pigment violet 19.

Examples of yellow pigments include C.I. Pigment yellow 1, 2, 3, 12, 13, 14C, 16, 17, 73, 74, 75, 83, 93, 95, 97, 98, 119, 110, 114, 128, 129, 138, 150, 151, 154, 155, 180, and 185 and preferable examples include a single pigment or a mixture of two or more pigments selected from the group consisting of C.I. Pigment yellow 74, 109, 110, 128, and 138.

As pigments for use in an orange pigment dispersion liquid, C.I. Pigment orange 36 or 43 or a mixture thereof is mentioned.

As pigments for use in a green pigment dispersion liquid, C.I. Pigment green 7 or 36 or a mixture thereof is mentioned. These pigments may be dispersed in resin using a dispersion resin or may be used as a self-dispersing pigment by oxidizing or sulfonating the pigment surface with ozone, hypochlorous acid, fuming sulfuric acid, or the like.

Specific preferable examples of the polymerizable oligomer to be added to the ink include urethane oligomers, such as polyester urethane acrylate, polyether urethane acrylate, polybutadiene urethane acrylate, and polyol urethane acrylate having a molecular weight in the range of 500 to 20,000. More specifically, preferable examples include U-4HA and U-15HA (all manufactured by Shin-Nakamura Chemical Co., Ltd.).

As the polymerizable polymer to be added to the ink, specifically, a dendrimer, a hyperbranched polymer, a dendrigraft polymer, a hyper-graft polymer, and the like that are solid at room temperature and have a molecular weight in the range of 2,000 to 50,000 (Dendritic Kobunshi-Tabunki Kozo ga Hirogeru Koukinouka no Sekai-(Dendritic Polymers-World of High Functionalization Diversified by Multi-branched Structures-), Keigo AOI and Masaaki KAKIMOTO (supervisors), NTS Inc) are preferable.

The addition amount of the polymerizable oligomer and/or polymer is preferably 10 to 50% by weight.

Specific examples of the photopolymerization initiator to be added to the ink include benzyl dimethyl ketal, α-hydroxy alkyl phenone, α-amino alkyl phenone, acyl phosphine oxide, oxime ester, thioxanthone, α-dicarbonyl, and anthraquinone.

In addition, photopolymerization initiators available under the trade names of Vicure 10 and 30 (all manufactured by Stauffer Chemical), Irgacure 127, 184, 500, 651, 2959, 907, 369, 379, 754, 1700, 1800, 1850, and 819, OXE01, Darocur 1173, TPO, and ITX (all manufactured by Ciba Specialty Chemicals), Quantacure CTX (manufactured by Aceto Chemical), Kayacure DETX-S (manufactured by Nippon Kayaku Co., Ltd.), and ESCURE KIP150 (manufactured by Lamberti) can also be used.

The addition amount of the photopolymerization initiator is preferably 3 to 10% by weight.

The mildly volatile organic solvent having a boiling point of 100° C. or more and 250° C. or lower and/or water are/is preferably further added to ink.

Specific examples of the mildly volatile organic solvent having a boiling point of 100° C. or more and 250° C. or lower incude N-methylpyrrolidone, N-ethyl pyrrolidone, N-vinyl pyrrolidone, 2-pyrrolidone, dimethylsulfoxide, ε-caprolactam, methyl lactate, ethyl lactate, isopropyl lactate, butyl lactate, ethylene glycol monomethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, propylene glycol monomethyl ether, dipropylene glycol monomethyl ether, dipropyrene glycol dimethyl ether, 1,4-dioxane, ethylene glycol, diethylene glycol, propylene glycol, dipropyrene glycol, 1,3-propanediol, 1,4-butanediol, hexylene glycol, n-butanol, 1,2-hexanediol, 1,3-hexanediol, 1,2-heptanediol, 1,3-heptanediol, 1,2-octanediol, 1,3-octanediol, 1,2-pentanediol, triethylene glycol monobutyl ether, diethylene glycol monobutyl ether, diethylene glycol monopropyl ether, diethylene glycol monopentyl ether, and propylene glycol monobutyl ether.

For example, when a moisturizer having a high boiling point, such as glycerin, is added to the ink, curing becomes insufficient when cured with electron beams or ultraviolet rays in the second fixing portion 50 particularly in printing to a target non-ink-absorbing recording medium, such as PET media, and thus water resistance.and scratch resistance of printed matter are not sufficiently obtained.

To the ink, a dispersant for a coloring agent, a resin emulsion, or a monomer solubility resin can be added as appropriate.

These resins need to have dispersibility in monomers even when the resins are insoluble in monomers. When a resin emulsion is used as a thermoplastic resin, the particle diameter thereof is not particularly limited insofar as an emulsion is formed and is preferably about 150 nm or lower and more preferably about 5 nm to about 100 nm.

In addition, in order to increase the stability when ink is ejected from an ink jet recording head, a surfactant can be added to the ink as required.

As a surfactant, silicone surfactants, such as polyester modified silicone and polyether modified silicone, are preferably used, and po yether modified polydimethyl siloxane or polyester modified polydimethyl siloxane is more preferably used. Specific examples include BYK-347 and 348, BYK-UV3500, 3510, 3530, and 3570 (all manufactured by BYK-Chemie Japan) but the examples are not limited thereto.

In addition, in order to improve the usability by making it possible to store the ink over a long period of time in a warehouse of room temperature, a thermal polymerization inhibitor can be added to the ink as required.

Examples of the thermal polymerization inhibitor include IrgastabUV-10 (manufactured by Ciba Specialty Chemicals) and are not limited thereto.

Figure 3:
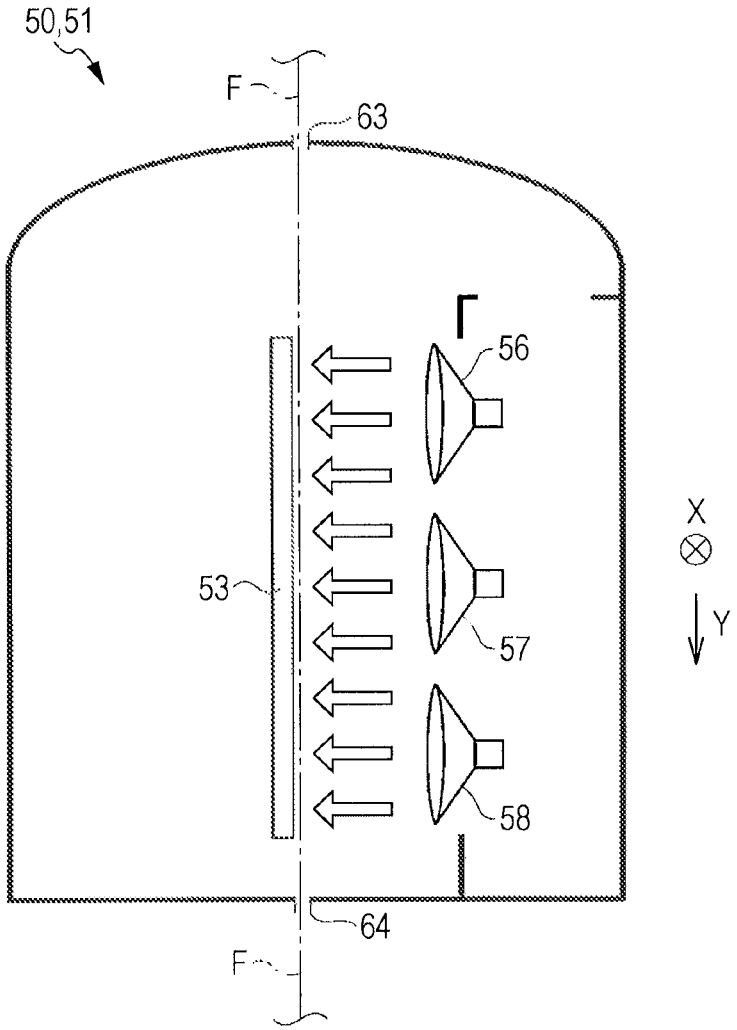
FIG. 3 is a side view illustrating the outline inside a second fixing portion of the printer according to this embodiment.

FIG. 3 illustrates a side view illustrating the outline inside the second fixing portion of the printer according to this embodiment.

As illustrated in FIG. 3, the second fixing portion 50 has a ultraviolet exposure device 51. Inside the ultraviolet exposure device 51, a first ultraviolet lamp 56, a second ultraviolet lamp 57, and a third ultraviolet lamp 58 are provided. When using LEDs, an LED having a luminescence peak wavelength of 395 nm as the first UV lamp 56, an LED having a luminescence peak wavelength of 380 nm as the second UV lamp 57, and an LED having a luminescence peak wavelength of 365 nm as the third UV lamp 58 are disposed in combination, for example.

As another light source usable as the ultraviolet exposure device 51, a high-pressure mercury lamp, a xenon lamp, a carbon arc light, a chemical lamp, a low-pressure mercury lamp, a metal halide lamp, an ultraviolet-ray emitting semiconductor laser, and the like may be used in addition to the above. In addition, commercially available one, such as an H lamp, a D lamp, or a V lamp available from Fusion System Corporation or the like, can also be used.

The medium support surface 53 is provided in such a manner as to support the target recording medium F fed into the second fixing portion 50 from an entrance 63.

In this embodiment, the target recording medium F is structured to be intermittently fed as described above. The period of time while the target recording medium F temporarily stops on the medium support face 53 is about 5 to about 50 seconds.

While temporarily stopping, the ink L can be fixed by polymerizing and curing the remaining ingredients after evaporating the liquid ingredients in the ink L adhering to the surface of the target recording medium F by ultraviolet rays or electron beams emitted from the light source of the ultraviolet exposure device 51 of the second fixing portion 50 in the drying portion 40. It is structured so that the polymerization and curing state can be adjusted by the intensity of ultraviolet rays, the period of time of temporarily stopping, the oligomer ingredients in the ink, the addition amount of the initiator, etc.

In particular, when the target recording medium is the target recording medium F into which moisture or the organic solvents in the ink ingredients does/do not penetrate, fixing the ink L in two stages by the drying portion 40 and the second fixing portion 50 of this embodiment is effective. Even when the target recording medium is paper, the ink L can be fixed efficiently. Thus, the ink fixation in two stages is effective. Also in the case of a recording mode in which the ink L is ejected in an amount larger than the usual amount, the ink L can be fixed efficiently. Thus, the ink fixation in two stages is effective.

When the polymerization and curing of the remaining ink ingredients is insufficient in the second fixing portion 50, the ink sometimes adheres to the portions of a fourth feeding roller 71 to a seventh feeding roller 74 in the ejecting portion 70, and further dirt sometimes adheres to the target recording medium itself due to transfer from the ink adhering portions.

Hereinafter, the invention will be more specifically described based on the printing evaluation results obtained by an actual machine, but it is a matter of course that the scope of the invention is not limited by the description.

Ink

Preparation of Ink

First, a pigment dispersion liquid was prepared by the method described below.

As a coloring agent, 20 parts of C.I. Pigment blue 15:3, 5 parts of DISCOALL (registered trademark) N-509 (manufactured by Dainichiseika Color & Chemicals Mfg. Co., Ltd.) as a dispersant, and 75 parts of allyl glycol (manufactured by Nippon Nyukazai Co., Ltd.) as a monomer were mixed, and were dispersed for 5 hours using a sand mill (manufactured by Yasukawa Seisakusho) together with zirconia beads (1.5 mm in diameter).

Thereafter, the zirconia beads were removed by a separator, thereby obtaining a dispersion liquid of a cyan pigment.

A dispersion liquid of a magenta pigment using C.I. Pigment red 122 as a coloring agent, a dispersion liquid of a yellow pigment using C.I. Pigment yellow 180 as a coloring agent, and a dispersion liquid of a black pigment using carbon black as a coloring agent were similarly prepared below.

Next, inks of the compositions shown below were prepared using each of the color pigment dispersion liquids above.

Cyan Ink Composition 1

A cyan ink was prepared in the following composition:

| | |
|---|---|
| C.I. Pigment blue 15:3 as a coloring agent | 4% by weight |
| DISCOALL N-509 as a dispersant for a coloring agent | 1% by weight |
| N-vinyl formamide as a monomer | 10% by weight |
| U-15HA as an oligomer | 20% by weight |
| Irgacure 127 as a photopolymerization initiator | 3% by weight |
| Irgacure 819 as a photopolymerization initiator | 2% by weight |
| Irgastab UV-10 as a thermal polymerization inhibitor | 0.2% by weight |
| BYK-UV3500 as a silicone surfactant | 0.2% by weight |
| Allyl glycol as a monomer | 59.6% by weight. |

Magenta Ink Composition 2

A magenta ink was prepared in the following composition:

| | |
|---|---|
| C.I. Pigment red 122 as a coloring agent | 5% by weight |
| DISCOALL N-509 as a dispersant for a coloring agent | 1.25% by weight |
| Allyl glycol as a monomer | 30% by weight |
| U-15HA as an oligomer | 50% by weight |
| Irgacure 127 as a photopolymerization initiator | 2% by weight |
| Irgacure 819 as a photopolymerization initiator | 1% by weight |
| 2-pyrrolidone as a mildly volatile organic solvent | 7.35% by weight |
| Irgastab UV-10 as a thermal polymerization inhibitor | 0.2% by weight |
| BYK-UV3500 as a silicone surfactant | 0.2% by weight |
| Pure water | 3% by weight. |

Yellow Ink Composition 3

A yellow ink was prepared in the following composition:

| | |
|---|---|
| C.I. Pigment yellow 180 as a coloring agent | 10% by weight |
| DISCOALL N-509 as a dispersant for a coloring agent | 2.5% by weight |
| 2-pyrrolidone as a mildly volatile organic solvent | 10% by weight |
| U-15HA as an oligomer | 10% by weight |
| Irgacure 127 as a photopolymerization initiator | 3% by weight |
| Irgacure 819 as a photopolymerization initiator | 2% by weight |
| Irgastab UV-10 as a thermal polymerization inhibitor | 0.2% by weight |
| BYK-UV3500 as a silicone surfactant | 0.2% by weight |
| Allyl glycol as a monomer | 62.1% by weight. |

Black Ink Composition 4

A black ink was prepared in the following composition:

| | |
|---|---|
| Carbon black as a coloring agent | 6% by weight |
| DISCOALL N-509 as a dispersant for a coloring agent | 1.5% by weight |
| N-methylpyrrolidone as a mildly volatile organic solvent | 20% by weight |
| U-15HA as an oligomer | 20% by weight |
| Irgacure 127 as a photopolymerization initiator | 7% by weight |
| Irgacure 819 as a photopolymerization initiator | 3% by weight |
| Irgastab UV-10 as a thermal polymerization inhibitor | 0.2% by weight |
| BYK-UV3500 as a silicone surfactant | 0.2% by weight |
| Allyl glycol as a monomer | 42.1% by weight. |

Printing Evaluation

Printing evaluation was performed using a printer structured as illustrated in FIGS. 1 to 3 for:

1) PVC film: ViewCAL (manufactured by Sakurai Co., Ltd., Model No. VC900B2),

2) Transparent PET film: SUPER KIMOART (manufactured by Kimoto Co., Ltd., SP2),

3) PP film: Cold LF (manufactured by LAMY C, Model No. PPG-20S) as a target recording medium.

As a recording head, a recording head mounted on Ink jet printer PX-B500 (trade name, manufactured by Seiko Epson Corporation) was used, and the ink compositions 1 to 4 above were charged in the recording head. Then, the following printing was performed with the ejected ink weight of 30 ng/dot (nanogram/dot) and a resolution of 360 dpi (a dot/inch):

I. Vertical and horizontal ruled lines formed with black 1 dot,

Solid printing with a duty of 100% of each color of cyan, magenta, and yellow,

III. Ruled lines of each color of cyan, magenta, and black formed with 3 dot on the yellow solid printed with a duty of 100%.

By changing the temperature of an attached heater 41 and the temperature and the air volume of a hot air fan 35 in the platen 34 as a drying portion during printing, the evaporation amount of the ink ingredients in the drying portion was controlled to achieve the following conditions, 30% of Test 1, 40% of Test 2, 50% of Test 3, 60% of Test 4, 70% of Test 5, and 80% of Test 6.

Next, the target recording medium after printing was fed to the ultraviolet exposure device 51 of the second fixing portion 50, and then polymerized and cured using D lamps manufactured by Fusion System as the first UV lamp 56, the second UV lamp 57, and the third UV lamp 58 at an irradiation intensity of each lamp of 100 mW/cm$^2$.

The irradiation time was adjusted as follows: 10 seconds in Tests 1 and 2 and 5 seconds in Tests 3, 4, 5, and 6.

The printing evaluation results were judged by visually observing the recorded matter by 5 subjects as follows:

A: No beading occurs, B: Beading occurs in Evaluation I,

A: No solid unevenness occurs, B: Solid unevenness occurs in Evaluation II,

A: No color bleed occurs, B: Color bleed occurs in Evaluation III. Then, the major judgments were adopted. The results are shown as Tests 1 to 6 in FIG. 4.

Next, a magenta ink composition 5 was prepared using glycerin as a low volatile organic solvent in place of the 2-pyrrolidone as the mildly volatile organic solvent of the magenta ink composition 2.

A black ink composition 6 was prepared using glycerin as a low volatile organic solvent in place of the N-methylpyrrolidone as the mildly volatile organic solvent of the black ink composition 4.

A test 7 was performed under the same conditions as those of Tests 1 to 6 in the above-described printing evaluation, except changing the magenta ink composition 2 to the magenta ink composition 5 and the black ink composition 4 to the black ink composition 6, respectively. The results are shown in FIG. 5.

Furthermore, eight-pass printing evaluation was performed for a PVC film: ViewCAL (manufactured by Sakurai Co., Ltd., Model No. VC900B) as a recording medium using the printer structured as illustrated in FIGS. 1 to 3 and using, as a recording head, a recording head mounted on Ink jet printer PX-5600 (trade name, manufactured by Seiko Epson Corporation) and charging the ink compositions 1 to 4 and the following ink compositions 7 to 9 in the recording head with the ejected ink weight of 5 ng/dot (nanogram/dot), a resolution of 1,440 dpi×1,440 dpi, and the ejection amount of 4 ng.

Light Cyan Ink Composition 7

A light cyan ink was prepared in the following composition:

| | |
|---|---|
| C.I. Pigment Blue 15:3 as a coloring agent | 0.5% by weight |
| DISCOALL N-509 as a dispersant for a coloring agent | 0.125% by weight |
| N-vinyl formamide as a monomer | 10% by weight |
| U-15HA as an oligomer | 50% by weight |
| Irgacure 127 as a photopolymerization initiator | 3% by weight |
| Irgacure 819 as a photopolymerization initiator | 2% by weight |
| Irgastab UV-10 as a thermal polymerization inhibitor | 0.2% by weight |
| BYK-UV3500 as a silicone surfactant | 0.2% by weight |
| Allyl glycol as a monomer | 33.975% by weight. |

Light Magenta Ink Composition 8

A light magenta ink was prepared in the following composition:

| | |
|---|---|
| C.I. Pigment Red 122 as a coloring agent | 0.5% by weight |
| DISCOALL N-509 as a dispersant for a coloring agent | 0.125% by weight |
| Allyl glycol as a monomer | 30% by weight |
| U-15HA as an oligomer | 50% by weight |
| Irgacure 127 as a photopolymerization initiator | 2% by weight |
| Irgacure 819 as a photopolymerization initiator | 1% by weight |
| 2-pyrolidone as a mildly volatile organic solvent | 7.35% by weight |
| Irgastab UV-10 as a thermal polymerization inhibitor | 0.2% by weight |
| BYK-UV3500 as a silicone surfactant | 0.2% by weight |
| Pure water | 8.625% by weight. |

Light Black Ink Composition 9

A light black ink was prepared in the following composition:

| | |
|---|---|
| Carbon black as a coloring agent | 0.2% by weight |
| DISCOALL N-509 as a dispersant for a coloring agent | 0.05% by weight |
| N-methylpyrrolidone as a mildly volatile organic solvent | 4.35% by weight |
| U-15HA as an oligomer | 20% by weight |
| Irgacure 127 as a photopolymerization initiator | 2% by weight |
| Irgacure 819 as a photopolymerization initiator | 3% by weight |
| Irgastab UV-10 as a thermal polymerization inhibitor | 0.2% by weight |
| BYK-UV3500 as a silicone surfactant | 0.2% by weight |
| Allyl glycol as a monomer | 70% by weight. |

In the Test above, gradation patterns with a duty of 0% to 100% of yellow, magenta, cyan, red, green, blue, and black were printed. The temperature of the attached heater 41 and the temperature and the wind volume of the hot air fan 35 were controlled in the platen 34 as the drying portion so that the evaporation amount of the ink ingredients in the drying portion was in the range of 40 to 70% in the printed patterns.

Next, the target recording medium after printing was fed to the ultraviolet exposure device 51 of the second fixing portion 50, and then polymerized and cured using D lamps manufactured by Fusion System used as the first UV lamp 56, the second UV lamp 57, and the third UV lamp 58 at an irradiation intensity of each lamp of 100 mW/cm$^2$.

The irradiation time was 10 seconds.

As a result, aggregation unevenness was not observed and favorable gradation was printed. The fixability of the printed matter was also favorable As is clear from the above results, by evaporating 40% by weight or more of the ink adhering to the target recording medium in the first drying portion, and further polymerizing and curing the remaining ink ingredients in the second fixing portion provided at the downstream side with respect to the first drying portion of the feeding direction of the target recording medium, high-quality image ink jet recording was performed at high speed to a target recording medium having low ink absorbability, such as a gross slightly-coated paper, used as this printing paper.

Furthermore, when 40% by weight or more of the ink adhering to the target recording medium is evaporated in the first drying portion, high-quality image ink jet recording was performed at high speed also to a non-ink-absorbing target recording medium, such as PVC, PET, and PP film. Conversely, when the evaporation amount in the first drying portion was smaller than the above-described amount, beading or solid unevenness due to an assembling phenomenon of inks occurred on the recording-medium surface or color bleed due to mixing of insufficiently dried color inks occurred on the target recording medium.

When more than 70% by weight of the ink adhering to the target recording medium was evaporated in the first drying portion, the amount of inks that contribute to printing decreased, and thus the ruled line width in the head scanning direction became narrow. As a result, on a non-ink-absorbing recording medium, such as PET media, white lines generated in a solid portion with a duty of 100%, and the white lines were recognized as solid unevenness by subjects. Thus, it was difficult to perform high-quality image ink jet recording.

As is clear from the printing results of Test 7 illustrated in FIG. 5, since glycerin which is a low volatile moisturizer having a boiling point of 290° C. was blended in the ink composition, a relatively long time is required until an appropriate amount is achieved in spite of evaporating an appropriate amount of ink in the first drying portion in a non-ink-absorbing recording medium, such as PVC, PET, or PP film and further the top surface of the adhering ink droplets was not sufficiently dried. Therefore, beading or solid unevenness due to an assembling phenomenon occurred, and thus it was difficult to perform high-quality image ink jet recording.

More specifically, according to the ink jet recording device of the invention and the recording method using the same, high-quality image recording was performed at high speed on a target non-ink absorbing recording medium. In this case, as compared with a recording device having a heating measure for promoting drying of ink at one portion near a recording head that has been proposed heretofore and a recording method using the same, heat for ink evaporation was efficiently given to a target recording subject and polymerization and curing of ink was efficiently performed with ultraviolet rays or electron beams, and thus the effect of suppressing the energy required for drying ink to a low level as a whole was obtained.

What is claimed is:

1. An ink jet recording system, comprising:

a recording head that ejects ink to the surface of a target non-ink-absorbing or low ink-absorbing recording medium;

a medium support portion that faces the recording head and supports the target recording medium from the back surface;

a drying portion as a first fixing portion that evaporates a liquid ingredient of the ink that is ejected to the target recording medium from the recording head and adheres thereto, the drying portion being integrated into the medium support portion; and a second fixing portion at the downstream side with respect to the drying portion and the recording head of a feeding direction of the target recording medium, the feeding direction at which the second fixing portion is arranged being orthogonal to the medium support portion, the ink at least containing:

(1) a coloring agent;

(2) a monomer which is an organic solvent having a boiling point in a range of 100° C. to 250° C.;

(3) a polymerizable oligomer and/or polymer; and (4) a photopolymerization initiator, the second fixing portion being an irradiation device that irradiates the target recording medium with ultraviolet ray or electron beam, and the evaporation amount of the liquid ingredient in the drying portion being 40 to 70% by weight of the ink adhering to the target recording medium.

2. The ink jet recording system according to claim 1, wherein (1) the coloring agent, (2) the monomer which is an organic solvent having a boiling point in the range of 100° C. to 250° C. or lower, (3) the polymerizable oligomer and/or polymer, and (4) the photopolymerization initiator contained in the ink contain:

(1) 0.2 to 10% by weight of a pigment as the coloring agent, (2) 3 0 to 70% by weight of one or two or more kinds of organic solvents selected from the group consisting of allyl glycol, N-vinyl formamide, (2-methyl2-ethyl-1, 3-dioxolane-4-yl-) methylacrylate, phenoxy ethyl acrylate, isobonyl acrylate, methoxy diethylene glycol monoacrylate, acryloyl morpholine, ethylene glycol dimethacrylate, diethylene glycol dimethacrylate, tripropylene glycol diacrylate, 1,9-nonanediol diacrylate, polyethylene-glycol #400 diacrylate, tetraethylene glycol dimethacrylate, 1,6hexanediol dimethacrylate, neopentylglycol dimethacrylate, 2-hydroxy-1, 3dimethacryloxy propane, trimethylol propane trimethacrylate, trimethylolpropane modified triacrylate, trimethylolpropane PO modified triacrylate, and glycerin PO modified triacrylate as the monomer, (3) 10 to 50% by weight of the polymerizable oligomer and/or polymer, and (4) 3 to 10% by weight of the photopolymerization initiator.

3. The ink jet recording system according to claim 1, wherein the ink contains:

(5) a mildly volatile organic solvent having a boiling point in the range of 100° C. to 250° C. or lower and/or water.

4. The ink jet recording system according to claim 3, wherein, (5) the mildly volatile organic solvent having a boiling point in the range of 100° C. to 250° C. contained in the ink contains two or more organic solvents selected from the group consisting of N-methyl pyrrolidone, Nethyl pyrrolidone, N-vinyl pyrrolidone, 2-pyrrolidone, dimethylsulfoxide, E-caprolactam, methyl lactate, ethyl lactate, isopropyl lactate, butyl lactate, ethylene glycol morioinethyl ether, ethylene glycol monomethyl ether acetate, diethylene glycol monomethyl ether, diethylene glycol dimethyl ether, diethylene glycol ethyl methyl ether, diethylene glycol diethyl ether, diethylene glycol isopropyl ether, propylene glycol monomethyl ether, dipropylene glycol monomethyl ether, dipropyrene glycol dimethyl ether, 1,4-dioxane, ethylene glycol, diethylene glycol, propylene glycol, dipropyrene glycol, 1,3-propanediol, 1,4-butanediol, hexylene glycol, n-butanol, 1,2-hexanediol, 1,3-hexanediol, 1,2heptanediol, 1,3-heptanediol, 1,2-octanediol, 1,3-octanediol, 1,2-pentanediol, triethylene glycol monobutyl ether, diethylene glycol monobutyl ether, diethylene glycol monopropyl ether, diethylene glycol monopentyl ether, and propylene glycol monobutyl ether.

5. An ink jet recording method, which is an ink jet recording method by the ink jet recording system according to claim 1, the ink jet recording method comprising:

ejecting ink to the surface of the target non-ink-absorbing or low ink-absorbing recording medium by the recording head;

evaporating a liquid ingredient of the ink adhering to the target recording medium in an amount of 40 to 70% by weight of the ink by the drying portion; and irradiating the target recording medium, in which the liquid ingredient is evaporated in the drying portion, with ultraviolet ray or electron beam by the irradiation device as the second fixing portion, and polymerizing and curing remaining ingredients after evaporating the liquid ingredient of the ink.

6. An ink jet recording method, which is an ink jet recording method by the ink jet recording system according to claim 2, the ink jet recording method comprising:

ejecting ink to the surface of the target non-ink-absorbing or low ink-absorbing recording medium by the recording head;

evaporating a liquid ingredient of the ink adhering to the target recording medium in an amount of 40 to 70% by weight of the ink by the drying portion; and irradiating the target recording medium, in which the liquid ingredient is evaporated in the drying portion, with ultraviolet ray or electron beam by the irradiation device as the second fixing portion, and polymerizing and curing remaining ingredients after evaporating the liquid ingredient of the ink.

7. An ink jet recording method by the ink jet recording system according to claim 3, the ink jet recording method comprising:

ejecting ink to the surface of the target non-ink-absorbing or low ink-absorbing recording medium by the recording head;

evaporating a liquid ingredient of the ink adhering to the target recording medium in an amount of 40 to 70% by weight of the ink by the drying portion; and irradiating the target recording medium, in which the liquid ingredient is evaporated in the drying portion, with ultraviolet ray or electron beam by the irradiation device as the second fixing portion, and polymerizing and curing remaining ingredients after evaporating the liquid ingredient of the ink.

8. An ink jet recording method, which is an ink jet recording method by the ink jet recording system according to claim 4, the ink jet recording method comprising:

ejecting ink to the surface of the target non-ink-absorbing or low ink-absorbing recording medium by the recording head;

evaporating a liquid ingredient of the ink adhering to the target recording medium in an amount of 40 to 70% by weight of the ink by the drying portion; and irradiating the target recording medium, in which the liquid ingredient is evaporated in the drying portion, with ultraviolet ray or electron beam by the irradiation device as the second fixing portion, and polymerizing and curing remaining ingredients after evaporating the liquid ingredient of the ink.

* * * * *